US009751746B2

(12) United States Patent
Clüsserath

(10) Patent No.: US 9,751,746 B2
(45) Date of Patent: Sep. 5, 2017

(54) PROBE FOR USE IN FILLING ELEMENTS OF FILLING MACHINES

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 185 days.

(21) Appl. No.: 14/408,332

(22) PCT Filed: Apr. 24, 2013

(86) PCT No.: PCT/EP2013/001236
§ 371 (c)(1),
(2) Date: Dec. 16, 2014

(87) PCT Pub. No.: WO2013/189561
PCT Pub. Date: Dec. 27, 2013

(65) Prior Publication Data

US 2015/0246805 A1 Sep. 3, 2015

(30) Foreign Application Priority Data

Jun. 19, 2012 (DE) ..... 10 2012 012 073

(51) Int. Cl.
*B67D 1/12* (2006.01)
*B67C 3/28* (2006.01)
*B67C 3/26* (2006.01)

(52) U.S. Cl.
CPC ..... *B67D 1/1238* (2013.01); *B67C 3/285* (2013.01); *B67C 2003/2685* (2013.01)

(58) Field of Classification Search
CPC ..... B65B 3/10; B67C 2003/2651; B67C 2003/2668; B67C 3/285; B67C 2003/2685; B67D 1/1238
USPC ..... 141/57
See application file for complete search history.

(56) References Cited

U.S. PATENT DOCUMENTS

| | | | | |
|---|---|---|---|---|
| 4,586,548 | A | 5/1986 | Hinxlage | |
| 5,634,500 | A * | 6/1997 | Clusserath | B67C 3/10 141/44 |
| 2005/0198921 | A1 * | 9/2005 | Clusserath | B67C 3/002 53/136.1 |

FOREIGN PATENT DOCUMENTS

| | | |
|---|---|---|
| DE | 3245731 | 6/1984 |
| DE | 8213939 | 9/1985 |
| DE | 4237044 | 12/1993 |
| DE | 20013676 | 11/2000 |
| EP | 0658511 | 6/1995 |
| EP | 0761591 | 3/1997 |
| EP | 2343518 | 7/2011 |
| FR | 2592869 | 7/1987 |
| WO | WO 94/00377 | 1/1994 |

* cited by examiner

*Primary Examiner* — Timothy L Maust
*Assistant Examiner* — Andrew Schmid
(74) *Attorney, Agent, or Firm* — Occhiuti & Rohlicek LLP

(57) ABSTRACT

An apparatus for filling a container with a free-flowing material includes a probe, a probe end, a return gas pipe, a gas channel, an opening, and a first electrical probe contact. During filling, the probe extends into the container along an axial direction with the probe's end determining the filling height. The probe includes a return gas pipe with an opening disposed at its end. The first electrical probe contact is formed at the probe end so that it is offset along the axial direction from the opening.

20 Claims, 4 Drawing Sheets

PROBE FOR USE IN FILLING ELEMENTS OF FILLING MACHINES

RELATED APPLICATIONS

This application is the national stage under 35 USC 371 of international application PCT/EP2013/001236, filed on Apr. 24, 2013, which claims the benefit of the Jun. 19, 2012 priority date of German application 10 2012 012 073.7, the content of which is herein incorporated by reference.

FIELD OF INVENTION

The invention relates to a probe, and in particular to a probe for determining the filling level during filling, and to a filling system or a filling machine for the filling of containers with a free-flowing or liquid filling material.

BACKGROUND

In filling machines, it is known to control how much filling material enters a container. This involves the use of a probe that extends into the container being filled. Among the known probes are electrical filling-level probes with a probe contact, and return gas pipes.

When immersed in the rising level of the filling material during filling of the container, the electrical filling-level probe delivers a probe signal that causes a liquid valve to close such that the respective target filling level in the container is attained.

A disadvantage of the electrical filling-level probe arises from the possibility that the probe contact and/or of electronics processing the probe signal may fail. When this occurs, the container may be over-filled.

Another known probe for determining the filling height is a return gas pipe. During the filling of a container arranged in a sealed position against the filling element, the return gas pipe conducts away any return gas displaced from the interior. The rising liquid level in the container eventually immerses the return gas pipe. Immersion of the gas pipe interrupts the flow of return gas through it, thus terminating any further inflow of the filling material into the container after the target filling level has been reached. As a result, positioning the return gas pipe along the axis amounts to controlling the filling level.

An advantage of using a return gas pipe as a probe is that one no longer has to worry about a fault with a probe contact and/or a fault in the electronics that processes the probe signal.

A disadvantage of filling systems with return gas pipes is that the liquid valve that supplies the filling material may not be closed immediately. In most cases, it is only closed after some time, for example when a filling station has reached a predetermined angle on a rotating transport element. As a result the liquid valve is closed only after the target filling height has long since been reached. During this time interval, there may be faults, such as pressure fluctuations, sudden changes in the circulation speed of the transport element, and/or vibrations. As a result of these faults, the container may become overfilled.

Another disadvantage is that sometimes, even after the return gas pipe has been immersed, filling material will still rise far into the return gas pipe or into its gas channel. As a result, after filling, it becomes necessary to empty the return gas pipe into the container to avoid having filling material drip after removing the filled container from the filling element. The time required for the emptying of the return gas pipe reduces performance, or throughput, of the filling machine. There is also the risk that contaminated filling material from a contaminated container will find its way into subsequent containers.

SUMMARY

An object of the invention is to provide a reliable probe having a simplified arrangement and reduced manufacturing costs for use with filling elements or filling machines for determining the filling height during filling in a way that avoids disadvantages of electrical filling level probes and return gas pipes, and that allows for the termination of the filling phase before the filling material enters the gas channel of the return gas pipe or before the entry of the filling material into the gas channel, thereby avoiding impairment of the filling process and/or impairment of the performance of the filling machine.

The invention combines the advantages of an electrical filling level probe with the fundamental advantages of a return gas pipe to delimit the filling height, and specifically without, at least in fault-free operation, the disadvantages of such a return gas pipe needing to be taken into account. At least during the filling or during the filling phase, the containers are in a sealed position against the filling element.

In one aspect, the invention features an apparatus for filling a container with a free-flowing material. Such an apparatus includes a filling element that has a probe, a probe end, a return gas pipe, a gas channel, an opening, and a first electrical probe contact. During filling, the probe extends into the container along an axial direction so that a probe end thereof determines, as a result of its location, a filling height of the filling material. The probe includes a return gas pipe having a gas channel that runs through it with the opening being an opening of the gas channel at the probe end. The first electrical probe contact is formed at the probe end, and is offset from the opening along the axial direction by a non-zero distance.

Some embodiments also include a lance that projects from the return gas pipe. In these embodiments, the first electrical probe contact is disposed on the lance.

Among these are embodiments in which the first electrical probe contact is disposed at an end of the lance that is furthest from the return gas pipe, embodiments in which the return gas pipe comprises a notched portion, wherein the notched portion forms a part segment, and wherein the lance is formed from the part segment, and embodiments in which the return gas pipe comprises a notched wall, wherein the notched wall forms a part segment, and wherein the lance is formed from the part segment.

Other embodiments include a lance that projects from the return gas pipe. In these embodiments, the first electrical probe contact is formed from the lance.

Yet other embodiments include a strip that projects from the return gas pipe, with the first electrical probe contact being disposed on the strip.

In other embodiments, the first electrical probe contact is disposed outside the gas channel.

Also included within the scope of the invention are those embodiments in which the filling element further comprises a second electrical probe contact. The first and second electrical probe contacts are separated along the axial direction, with one of them being disposed outside the gas channel at some non-zero distance in front of the opening.

In additional embodiments, there is a filling machine, with the probe being a constituent element of the filling machine.

In some of these embodiments, the filling machine comprises a plurality of filling positions, each of which comprises both a filling element and a container carrier. In these embodiments, the first electrical probe contact is offset in a direction towards the container carrier and opposite the opening.

Also included within the scope of the invention are embodiments in which the filling machine further comprises a control device. In such embodiments, the control device responds to a signal from the first probe contact by closing a liquid valve.

In other embodiments, a control device responds to a signal from the first probe contact by switching from a first operational mode to a second operational mode. For example, the control device may respond by switching from a fast filling mode to a slow filling mode.

In other embodiments, a control device responds to a signal from the first probe contact by activating a timer.

In yet other embodiments, the control device responds to a signal from the first probe contact by causing a liquid valve to close following lapse of a selected delay. Among these are embodiments in which the delay is selected to cause the liquid valve to close at a selected filling height based on process parameters. Examples of suitable process parameters include container size, container type, and type of filling material.

In another aspect, the invention includes an apparatus for filling a container with a free-flowing material, such as a liquid material or a free-flowing granular solid. Such an apparatus includes a probe, a probe end, a return gas pipe, a gas channel, an opening, and a first electrical probe contact. During filling, the probe extends into the container along an axial direction with the probe's end determining the filling height. The probe includes a return gas pipe with an opening disposed at its end. The first electrical probe contact is formed at the probe end so that it is offset along the axial direction from the opening.

As used herein, "containers" include cans and bottles made of metal, glass, and/or plastic, as well as other packing materials that are suitable for the filling of liquid or viscous products.

As used herein, a "head space" of a containers is that part of the interior of the container beneath the container opening, that is not occupied by the filling material after filling has been completed.

As used herein, "essentially" refers to deviations from a precise value by +/−10%, preferably by +/−5%, and/or deviations that are insignificant for function.

Further embodiments, advantages, and application possibilities of the invention are also derived from the following description of exemplary embodiments and from the figures. In this situation, all the features described and/or represented as images are, by themselves or in any desired combination, fundamentally the object of the invention, irrespective of their inclusion in the claims or referral back to them. The contents of the claims are also constituent parts of the description.

BRIEF DESCRIPTION OF THE FIGURES

The invention is explained in greater detail hereinafter on the basis of the figures in relation to an exemplary embodiment. In the figures.

DETAILED DESCRIPTION

Figure 1:
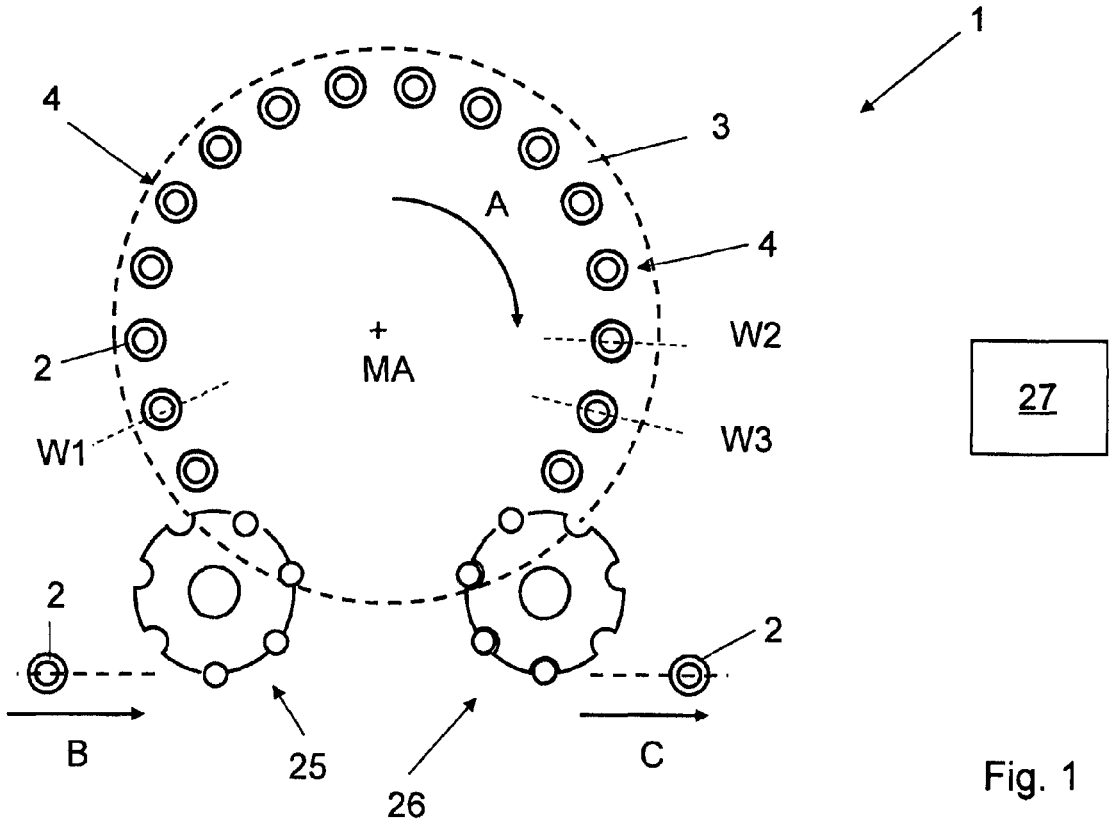
FIG. 1 is a schematic representation and view from above, of a filling machine according to the invention.

FIG. 1 shows a circulating filling machine 1 for filling containers 2, such as bottles, with a free flowing or liquid filling material. The filling machine 1 includes a rotor 3 that is driven to rotate about a vertical machine axis MA. Filling positions 4 are distributed along equal angle intervals These filling stations 4 are arranged at the same radial distance interval from the machine axis MA.

Figure 2:
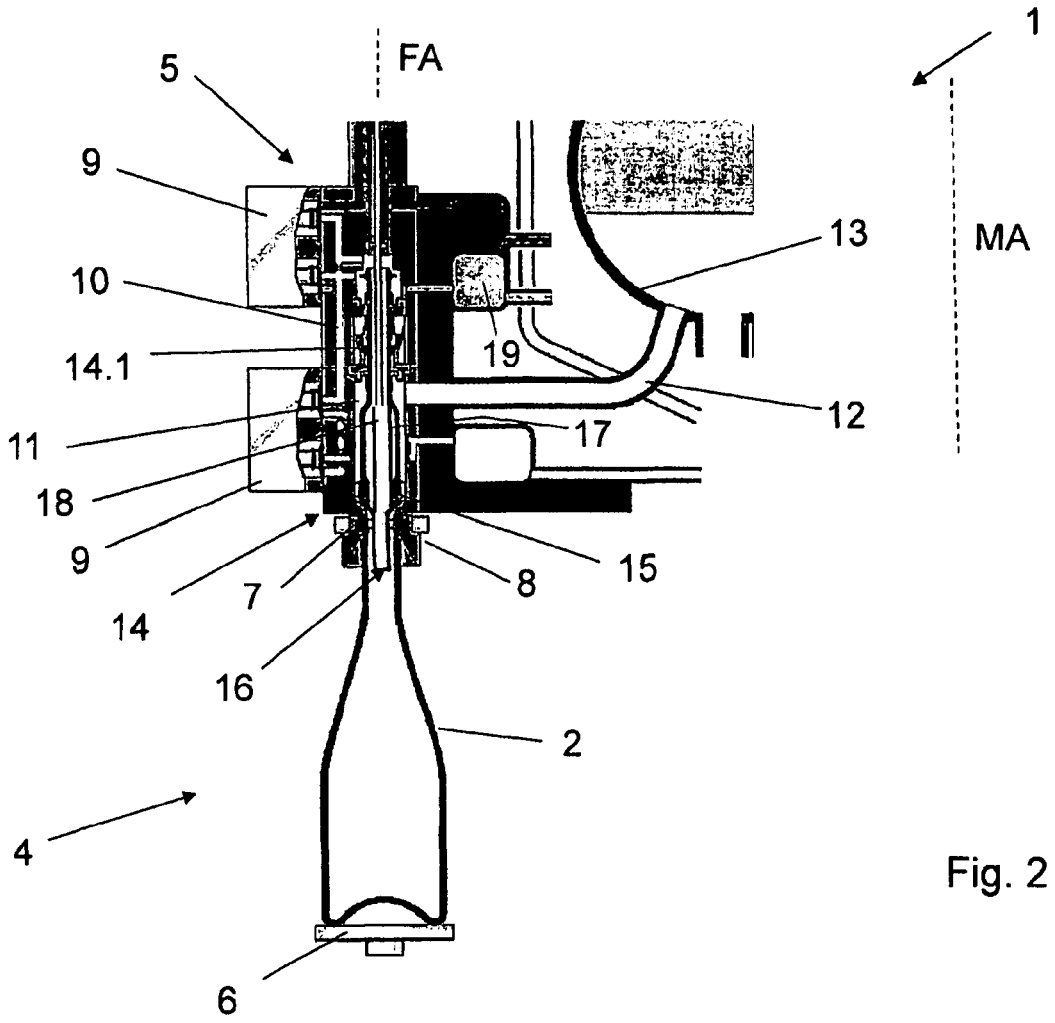
FIG. 2 is a simplified representation in a sectional view of one of the filling elements of the filling machine from FIG. 1, together with a bottle, arranged in the sealed position at the filling element.
Figure 3:
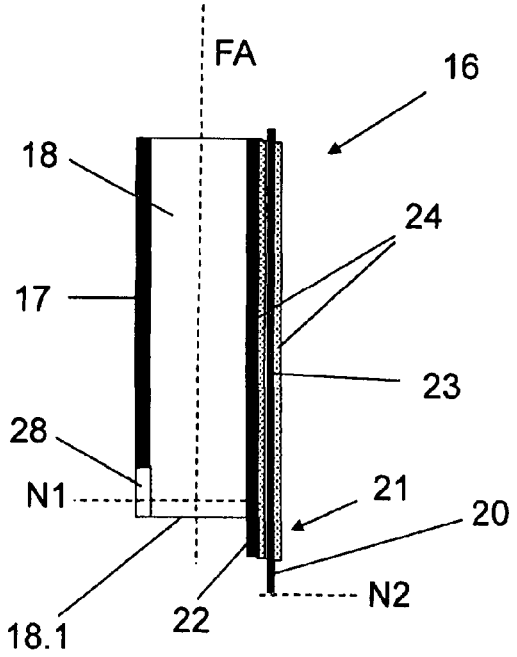
FIGS. 3 and 4, are simplified sectional representations of the lower end of a probe that determines the filling height of the filling material in a container, in section and in a view from below.
Figure 4:
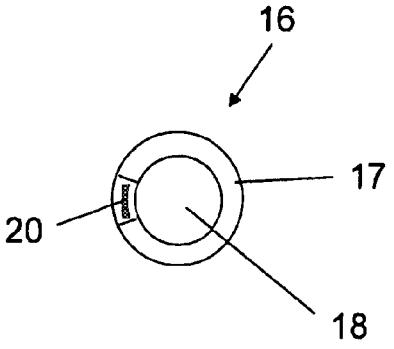

Referring to FIG. 2, each filling position 4 comprises a filling element 5 and a container carrier 6. In the embodiment shown, the container carrier 6 is a bottle plate.

During filling, a container 2 is pressed in a sealed position against the filling element 5. Specifically, the container 2 is pressed in the area of an annular outlet opening 7, or annular gap or in the area of a seal into a centering groove 8 at that point.

The filling element 5 has a housing 9 that contains gas channels 10 and a liquid channel 11. The gas channels 10 are controlled, for example, by pneumatically actuated control valves. The liquid channel 11 opens on the underside of the filling element 5 at the outer opening 7 and connects, on its upper side via a product line 12, to a filling material chamber 13 provided at the rotor 3.

The filling material chamber 13 is common to all the filling positions 4. During the filling of the containers 2, the chamber 13 is filled with the liquid filling material. In some embodiments, the liquid filling material is under filling pressure.

Inside the liquid channel 11 is a liquid valve 14. The liquid valve 14 opens at the beginning of the filling phase and closes in a controlled manner when the filling material level in the container 2 reaches a target level N1 that corresponds to the target filling height or the target filling quantity. As a result, the container 2 is filled to the required target filling height or the corresponding target filling quantity.

In the illustrated embodiment, the liquid valve 14 comprises a valve body 15 that interacts with a valve surface in the liquid channel 11. An actuating device 14.1 moves the valve body 15 up and down along a vertical filling element axis FA oriented parallel to the machine axis MA. This up and down movement opens and closes the liquid valve 14.

The filling element 5 further comprises a return gas pipe 17, arranged on the same axis as the filling element axis FA. The return gas pipe 17 forms a gas channel 18. A probe 16 that determines the filling height is disposed on the return gas pipe 17.

The return gas pipe 17 has a probe end having a lower opening 18.1. During filling, the lower end of the return gas pipe 17 extends into an upper volume of a container 2 that is arranged at the filling position. This upper volume will eventually become the headspace of the container 2.

During a pre-tensioning phase, the container 2 is filled with a pre-tensioning medium. This pre-tensioning medium can be air, inert gas, or $CO_2$ gas.

As liquid filling material enters the container 2 during the filling phase, it displaces the pre-tensioning medium. The displaced pre-tensioning medium escapes via the gas channel 18 into controlled gas paths 10 that ultimately guide it to a gas space formed above the filling material level in the filling material chamber 13 and/or into an annular channel 19 at the rotor 3, both of which are common to all the filling positions 4.

In conventional filling systems, liquid filling material eventually immerses the lower end of the return gas pipe 17. This halts the escape of gas through the return gas pipe 17, which thus halts the flow of filling material into the container 2. However, at this point, the liquid valve 14 would not yet have been closed. It is only later, i.e. at a predetermined angle position of the rotational movement of the rotor 3, that the closure of the liquid valve 14 actually takes place.

The delay associated with closing the liquid valve 14 has substantial disadvantages as described above. In order to avoid these, the probe 16 and its return gas pipe 17 are additionally designed as electrical filling level probes. In particular, a probe contact 20 is added outside the gas channel 18 at a lance-like or tab-like segment 21 of the return gas pipe 17. The segment 21 points downwards above the lower, open end 18.1 of the gas channel 18 in the direction of the filling element axis FA, i.e. in the direction of the container carrier 6.

In the embodiment shown, the segment 21 extends along the circumferential direction of the return gas pipe 17 to an extent that is perceptibly smaller than the circumference of the return gas pipe 17 at its lower end. In the illustrated embodiment, the segment 21 is in part formed from a tab-shaped or lance-shaped continuation or from a tab-shaped or lance-shaped part segment 22 of the wall of the return gas pipe 17 that is manufactured from an electrically conductive material, which is preferably a metallic material. This part segment 22 is produced, for example, by notching out a pipe piece that forms the return gas pipe 17 at its lower end.

An electrically-conducting path 23 extends along the lower end of the return gas pipe 17. Insulating layers 24 cover both sides of the electrically-conducting path 23 over most of its length. As a result, the electrically-conducting path 23 is insulated from the return gas pipe 17 and from the exterior space surrounding the return gas pipe 17. A lower free end of the electrically-conducting path 23, which is the only portion exposed, forms the probe contact 20. The probe contact 20 is exposed at the lower free end of the segment 21 at the level N2.

It is understood that the probe contact 20 can be formed in the area of the return gas pipe 17 in a way other than that described above. It is therefore, in principle, also possible for the segment 21, which projects above the lower, open end 18.1, to be formed exclusively from the conductor path 23 and, as appropriate from the insulating layers 24. A feature common to all embodiments have the feature in common, however, is the probe contact's location on the level N2 at a distance below the open end 18.1 of the return gas pipe 18 along the direction of the filling element axis FA.

Figure 5:
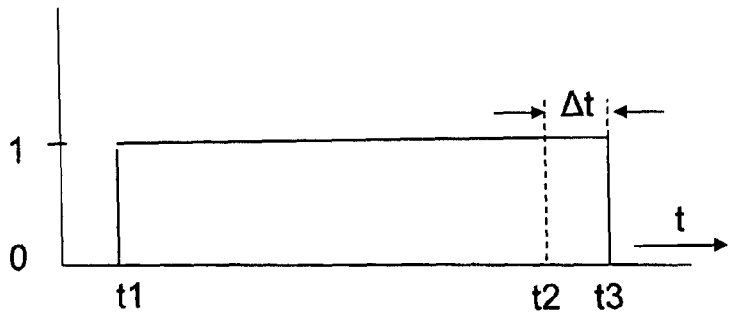
FIG. 5 is a time diagram showing the opening and closing of the liquid valve of the filling element of the filling machine from FIG. 1.

FIG. 5 shows the opening and closing of the liquid valve 14 at the beginning and end of a filling phase. In FIG. 5, "1" designates the opened state of the liquid valve 14, and "0" the closed state.

In operation, containers 2 that are to be filled are conveyed via an external conveying system in the direction of the arrow B. The containers 2 individually pass into a filling position 4 via a container inlet 25. The filled containers 2 are taken from the filling positions to a container outlet 26 and conveyed according to the arrow C to a further treatment stage. Over the angle range of the rotational movement of the rotor 3, between the container inlet 25 and the container outlet 26, a pre-treatment of the containers 2 takes place.

The pre-treatment includes arranging the container 2 in a sealed position against the filling element 5. Then, the interior of the container is flushed and/or pre-tensioned using an inert gas, such as $CO_2$.

The filling phase is initiated when the liquid valve 14 opens at time t1, shown in FIG. 5. This corresponds to the moment at which the filling position 4 reaches the angle position W1, as shown in FIG. 1.

Once the liquid valve 14 opens, the level of filling material rises in the interior of the container 2. Eventually, the filling material level reaches the level N2. At this point, the probe contact 20 responds. This occurs at time t2, which corresponds to the angle position W2. Response of the probe contact 20 activates a timer. After a time delay Δt, which is controlled by the timer, the liquid valve 14 closes. This corresponds to t3 in FIG. 5.

The time delay Δt is adjusted in such a way that the filling material level in the container 2, continues to rise until it reaches the target level, even after the closure of the liquid valve 14.

The angle W1 at which the liquid valve 14 opens is fixed. However, the angle positions W2 and W3 are not. These positions depend, for example, on the rotational speed of the rotor 3. The time delay Δt, which is independent of the rotational speed of the rotor 3, is determined empirically, based on, for example, previous filling cycles and/or from experiments. The time delay Δt is stored in a table of time delays at a computer 27 that controls the filling machine 1. For a particular process, a corresponding time delay can be retrieved.

The filling machine 1 and its filling element 5 as described herein avoids the disadvantages of the prior art. In addition, it guarantees a simplified mechanical arrangement with reduced manufacturing and/or assembly costs. Additionally, the filling machine 1 provides greater operational reliability because even if the probe contact 20 and/or the electronics were to fail, the return gas pipe 17 will still limit filling height.

The return gas pipe 17 has further functions. For example, during pre-treatment, the return gas pipe 17 provides passage for the pre-tensioning medium.

In the embodiment shown, the return gas pipe 17 has a lateral cut-out aperture 28 at its lower open end 18.1. This allows the head space to be flushed with inert gas after closure of the liquid valve 14 despite the short axial length of the segment 21 and despite the fact that the target level N1 lies somewhat above the level of the open end 18.1.

The invention has been described heretofore on the basis of an exemplary embodiment. It is understood that numerous changes and derivations are possible without departing from the inventive thinking upon which the invention is based.

For example, an alternative embodiment has plural probe contacts 20. These include a proximal and distal probe contact spaced apart from each other in the direction of the filling element axis FA. The distal probe contact in this embodiment is further from the open end 18.1 than the proximal probe contact.

In operation, actuation of the distal probe contact switches the filling element 5 from a rapid filling state to a slow filling state. In the fast filling state, the flow rate into the container is higher than it is in the slow filling state. As the level continues to rise, albeit more slowly, the level will eventually reach the proximal probe contact 20. At this point, the timer function is actuated as described above.

In another embodiment, actuation of the probe contact 20 causes immediate closure of the liquid valve 14 or immediately switches the filling element 1 into another operational state. One switch in operational states is the switch from the rapid filling mode into the slow filling mode.

I claim:

1. An apparatus for filling a container with a free-flowing material, said apparatus comprising a filling element, wherein said filling element comprises a probe, a probe end, a return gas pipe, a gas channel, an opening, and a first electrical probe contact, wherein, during filling, said probe extends into said container along an axial direction, wherein said probe end is an end of said probe, wherein a location of said probe end determines a filling height of said filling material, wherein said probe comprises a return gas pipe, wherein said gas channel is a channel through said return gas pipe, wherein said opening is an opening of said gas channel, wherein said probe end comprises said opening, wherein said first electrical probe contact is formed at said probe end and at an end of said gas channel, and wherein said first electrical probe contact is offset from said opening along said axial direction by a non-zero distance.

2. The apparatus of claim 1, further comprising a lance, wherein said lance projects from said return gas pipe, and wherein said first electrical probe contact is disposed on said lance.

3. The apparatus of claim 2, wherein said first electrical probe contact is disposed at an end of said lance that is furthest from said return gas pipe.

4. An apparatus for filling a container with a free-flowing material, said apparatus comprising a filling element, wherein said filling element comprises a probe, a probe end, a return gas pipe, a gas channel, an opening, and a first electrical probe contact, wherein, during filling, said probe extends into said container along an axial direction, wherein said probe end is an end of said probe, wherein a location of said probe end determines a filling height of said filling material, wherein said probe comprises a return gas pipe, wherein said gas channel is a channel through said return gas pipe, wherein said opening is an opening of said gas channel, wherein said opening is disposed at said probe end, wherein said first electrical probe contact is formed at said probe end, wherein said first electrical probe contact is offset from said opening along said axial direction by a non-zero distance, wherein said first electrical probe contact is disposed at an end of said lance that is furthest from said return gas pipe, wherein said return gas pipe comprises a notched portion, wherein said notched portion forms a part segment, and wherein said lance is formed from said part segment.

5. An apparatus for filling a container with a free-flowing material, said apparatus comprising a filling element, wherein said filling element comprises a probe, a probe end, a return gas pipe, a gas channel, an opening, and a first electrical probe contact, wherein, during filling, said probe extends into said container along an axial direction, wherein said probe end is an end of said probe, wherein a location of said probe end determines a filling height of said filling material, wherein said probe comprises a return gas pipe, wherein said gas channel is a channel through said return gas pipe, wherein said opening is an opening of said gas channel, wherein said opening is disposed at said probe end, wherein said first electrical probe contact is formed at said probe end, wherein said first electrical probe contact is offset from said opening along said axial direction by a non-zero distance, wherein said first electrical probe contact is disposed at an end of said lance that is furthest from said return gas pipe, wherein said return gas pipe comprises a notched wall, wherein said notched wall forms a part segment, and wherein said lance is formed from said part segment.

6. The apparatus of claim 1, further comprising a lance, wherein said lance projects from said return gas pipe, and wherein said first electrical probe contact is formed from said lance.

7. The apparatus of claim 1, further comprising a strip, wherein said strip projects from said return gas pipe, and wherein said first electrical probe contact is disposed on said strip.

8. The apparatus of claim 1, wherein said first electrical probe contact is disposed outside said gas channel.

9. The apparatus of claim 1, wherein said filling element further comprises a second electrical probe contact, wherein said first and second electrical probe contacts are separated along said axial direction, wherein one of said first and second electrical probe contacts is disposed outside said gas channel at a distance in front of said opening.

10. The apparatus of claim 1, further comprising a filling machine, wherein said probe is a constituent of said filling machine.

11. The apparatus of claim 10, wherein said filling machine comprises a plurality of filling positions, each of which comprises a filling element, and a container carrier, wherein said first electrical probe contact is offset in a direction towards said container carrier and opposite said opening.

12. The apparatus of claim 10, wherein said filling machine further comprises a control device, wherein in response to a signal from said first probe contact, said control device causes closing of a liquid valve.

13. The apparatus of claim 10, wherein said filling machine further comprises a control device, wherein in response to a signal from said first probe contact, said control device switches said filling element from a first operational mode to a second operational mode.

14. The apparatus of claim 10, wherein said filling machine further comprises a control device, wherein in response to a signal from said first probe contact, said control devices activates a timer.

15. The apparatus of claim 10, wherein said filling machine further comprises a control device, wherein in response to a signal from said first probe contact, said control device causes a liquid valve to close following lapse of a selected delay.

16. The apparatus of claim 15, wherein said filling machine further comprises a control device, wherein said delay is selected to cause said liquid valve to close at a selected filling height based on process parameters.

17. The apparatus of claim 16, wherein said process parameters comprise container size.

18. The apparatus of claim 16, wherein said process parameters comprise filling material.

19. The apparatus of claim 16, wherein said process parameters comprise container type.

20. The apparatus of claim 10, wherein said filling machine further comprises a control device, wherein in response to a signal from said first probe contact, said control device switches said filling element from operating in a rapid filling mode to operating in a slow filling mode.

* * * * *